US007520723B2

(12) United States Patent
Liang

(10) Patent No.: US 7,520,723 B2
(45) Date of Patent: Apr. 21, 2009

(54) TURBINE AIRFOIL COOLING SYSTEM WITH NEAR WALL VORTEX COOLING CHAMBERS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 396 days.

(21) Appl. No.: 11/482,616

(22) Filed: Jul. 7, 2006

(65) Prior Publication Data

US 2008/0008598 A1 Jan. 10, 2008

(51) Int. Cl.
*F01D 5/18* (2006.01)

(52) U.S. Cl. ..... 416/97 R

(58) Field of Classification Search ..... 415/115; 416/90 R, 95, 96 R, 97 R
See application file for complete search history.

(56) References Cited

U.S. PATENT DOCUMENTS

| | | | | | |
|---|---|---|---|---|---|
| 4,021,139 | A | | 5/1977 | Franklin | |
| 4,142,824 | A | | 3/1979 | Anderson | |
| 4,236,870 | A | * | 12/1980 | Hucul et al. | 416/97 R |
| 4,390,320 | A | | 6/1983 | Eiswerth | |
| 4,424,001 | A | | 1/1984 | North et al. | |
| 4,515,526 | A | | 5/1985 | Levengood | |
| 4,565,490 | A | | 1/1986 | Rice | |
| 4,669,957 | A | | 6/1987 | Phillips et al. | |
| 5,253,976 | A | | 10/1993 | Cunha | |
| 5,261,789 | A | | 11/1993 | Butts et al. | |
| 5,320,485 | A | | 6/1994 | Bourguignon et al. | |
| 5,413,463 | A | | 5/1995 | Chiu et al. | |
| 5,611,662 | A | | 3/1997 | Cunha | |
| 5,738,493 | A | | 4/1998 | Lee et al. | |
| 6,142,734 | A | * | 11/2000 | Lee | 416/97 R |
| 6,981,846 | B2 | | 1/2006 | Liang | |
| 2007/0128034 | A1 | * | 6/2007 | Lee et al. | 416/97 R |

FOREIGN PATENT DOCUMENTS

| | | | |
|---|---|---|---|
| EP | 0034961 | A1 | 9/1981 |

* cited by examiner

*Primary Examiner*—Edward Look
*Assistant Examiner*—Dwayne J White

(57) ABSTRACT

A cooling system for a turbine airfoil of a turbine engine having a plurality of vortex cooling chambers positioned in an outer wall defining a suction side of the turbine airfoil. The vortex cooling chambers may extend generally spanwise and be positioned in the outer wall from a position in close proximity to the leading edge to the trailing edge. The vortex cooling chambers may form a continuous cooling fluid flow path from the leading edge to the trailing edge in the outer wall forming the suction side of the turbine airfoil. The vortex cooling chambers may be fed with cooling air from a central cooling fluid chamber through a leading edge cooling chamber.

20 Claims, 4 Drawing Sheets

TURBINE AIRFOIL COOLING SYSTEM WITH NEAR WALL VORTEX COOLING CHAMBERS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for a cooling system capable of providing sufficient cooling to turbine airfoils.

SUMMARY OF THE INVENTION

This invention relates to a cooling system for turbine airfoils used in turbine engines. In particular, the turbine airfoil cooling system may include an internal cavity positioned between outer walls of the turbine airfoil. The cooling system may also include a plurality of vortex cooling chambers in an outer wall of the airfoil that may be adapted to receive cooling fluids from the internal cavity, meter the flow of cooling fluids through the outer wall, and release the cooling fluids from the airfoil through one or more trailing edge bleed slots.

The turbine airfoil may be formed, in general, from a generally elongated, hollow airfoil having a leading edge, a trailing edge, a tip section at a first end, a root coupled to the airfoil at an end generally opposite the first end for supporting the airfoil and for coupling the airfoil to a disc. The airfoil may include a cooling system formed from at least one cavity in the elongated, hollow airfoil. The outer wall forming the generally elongated airfoil may include a portion proximate to a suction side of the generally elongated airfoil. The outer wall proximate to the suction side may include a plurality of vortex cooling chambers extending in a generally spanwise direction and include trip strips. The vortex cooling chambers may be in fluid communication with each other through vortex cooling chamber bleed slots positioned between each row of vortex cooling chambers and in communication with the adjacent vortex cooling chambers. At least one vortex cooling chamber may be positioned in close proximity to the leading edge of the generally elongated, hollow airfoil. The cooling system may also include one or more trailing edge bleed slots extending from one of the vortex cooling chambers through the trailing edge for exhausting cooling fluids from the generally elongated airfoil. The vortex cooling chambers, the vortex cooling chamber bleed slots, and the at least one trailing edge bleed slot may form a continuous cooling circuit in the outer wall of the generally elongated, hollow airfoil from close proximity of the leading edge, along the suction side and through the trailing edge.

The cooling system of the airfoil may also include a leading edge cooling channel positioned proximate to the leading edge of the airfoil. The leading edge cooling channel may be in fluid communication with the vortex cooling chambers through one or more leading edge bleed slots. The leading edge cooling channel may include one or more trip strips.

The internal cavity may be formed from one or more central cooling fluid chambers. The central cooling fluid chambers may have any appropriate configuration. In at least one embodiment, the central cooling fluid chamber may include one or more pin fins extending generally from an outer wall on a pressure side toward the suction side. The central cooling fluid chambers may be in fluid communication with the leading edge cooling channel through one or more central cooling fluid bleed slots.

In an alternative embodiment of the airfoil, the cooling system may include re-supply holes in the outer wall that place one or more of the vortex cooling chambers in direct fluid communication with the central cooling fluid chamber. The re-supply holes may be placed in any appropriate position as determined by local heat loads. In one embodiment, the re-supply holes may be positioned downstream of a vortex cooling chamber row that is adjacent to the leading edge cooling chamber and at least one second re-supply hole positioned downstream of the first re-supply hole. The size and configuration of the re-supply holes may be based upon heat loads, pressure ranges, and other criteria.

During use, cooling fluids flow into the central cooling fluid chamber and by the pin fins. The cooling fluids increase in temperature as the cooling fluids cool the internal aspects of the turbine airfoil. The cooling fluids may then pass through the central cooling fluid chamber bleed slots and into the leading edge cooling channel. The central cooling fluid chamber bleed slots may create vortices of cooling fluids entering the leading edge cooling channel. The trip strips may also increase the turbulence in the leading edge cooling channel. The cooling fluids then flow through the leading edge bleed slots and into the vortex cooling chamber. As previously discussed, the configuration of the intersection between the leading edge bleed slots and the vortex cooling chambers create vortices in the vortex cooling chamber. In addition, the trip strips increase the turbulence in the vortex cooling chambers. The cooling fluids flow through the rows of vortex cooling chambers and increase in temperature. The cooling fluids may then be discharged from the turbine airfoil cooling system through the trailing edge bleed slots.

An advantage of this invention is that the multiple vortex cooling chambers may be designed based on airfoil gas side pressure distributions in both chordwise and spanwise directions.

Another advantage of this invention is that each individual vortex cooling chamber may be designed based on the airfoil local external heat load to achieve a desired local metal temperature level by varying the tangential velocities and pressure levels within each vortex cooling chamber.

Yet another advantage of this invention is that the flow of cooling fluids through the central cooling fluid chambers, through the leading edge cooling channel, through the vortex cooling chambers, and through the trailing edge bleed slots maximize the potential of using total available cooling fluid pressure.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
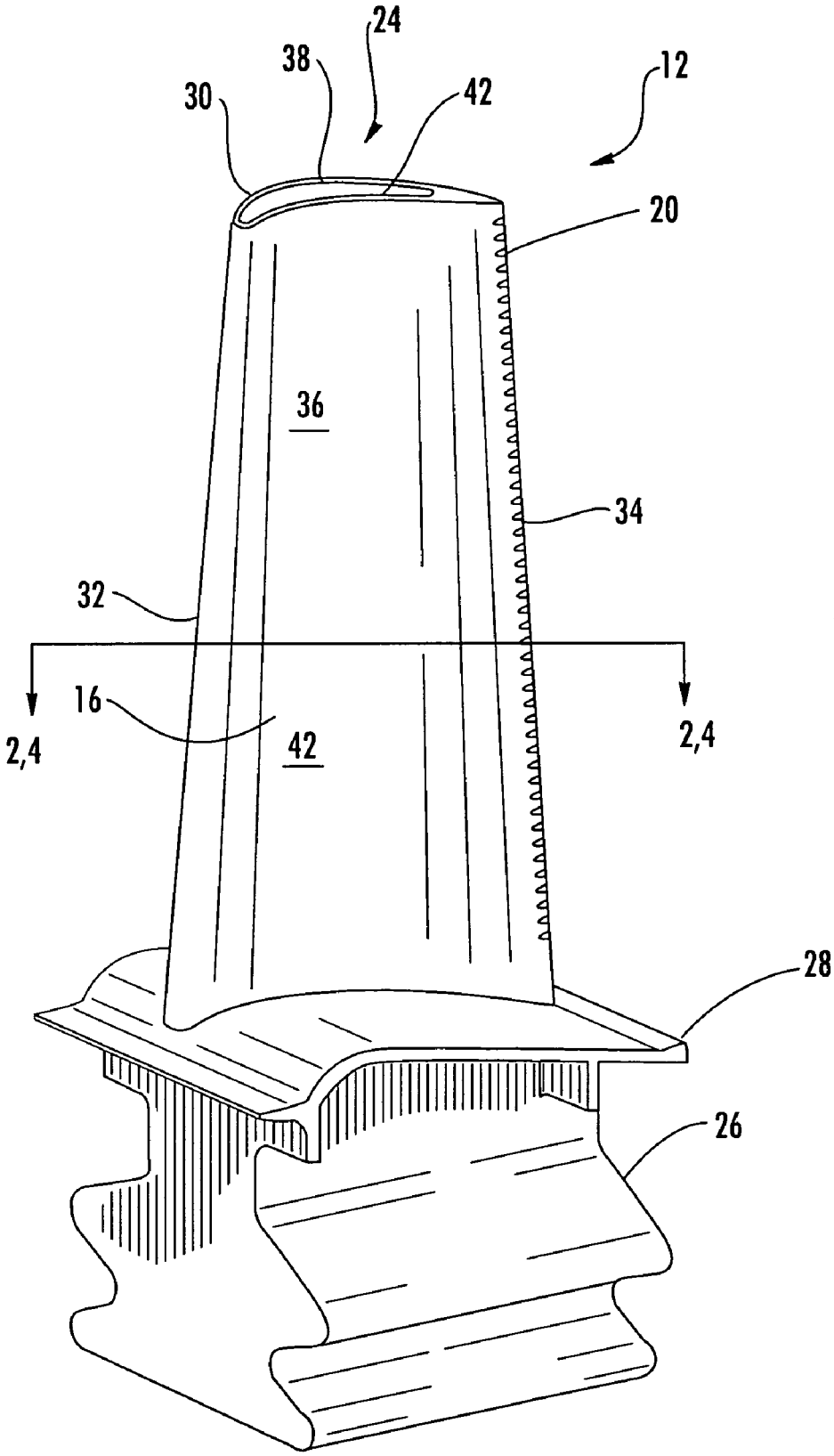
FIG. 1 is a perspective view of a turbine airfoil having features according to the instant invention.
Figure 2:
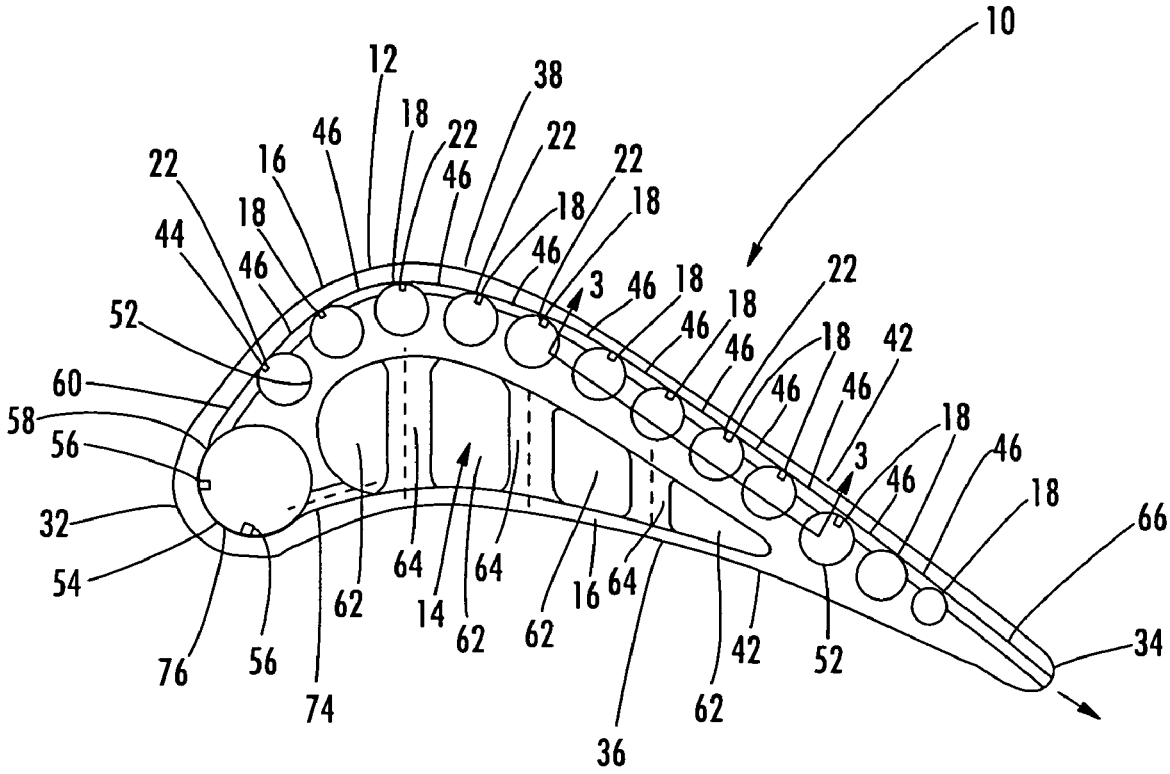
FIG. 2 is a cross-sectional view of the turbine airfoil shown in FIG. 1 taken along line 2-2.

As shown in FIGS. 1-4, this invention is directed to a turbine airfoil cooling system 10 for a turbine airfoil 12 used in turbine engines. In particular, the turbine airfoil cooling system 10 includes a plurality of internal cavities 14, as shown in FIG. 2, positioned between outer walls 16 of the turbine airfoil 12. The cooling system 10 may include a plurality of vortex cooling chambers 18 in the outer wall 16 that may be adapted to receive cooling fluids from the internal cavity 14, meter the flow of cooling fluids through the outer wall 16, and release the cooling fluids from the airfoil 12 through one or more trailing edge bleed slots 20.

The turbine airfoil 12 may be formed from a generally elongated, hollow airfoil 24 coupled to a root 26 at a platform 28. The turbine airfoil 12 may be formed from conventional metals or other acceptable materials. The generally elongated airfoil 24 may extend from the root 26 to a tip section 30 and include a leading edge 32 and trailing edge 34. Airfoil 24 may have an outer wall 16 adapted for use, for example, in a first stage of an axial flow turbine engine. Outer wall 16 may form a generally concave shaped portion forming pressure side 36 and may form a generally convex shaped portion forming suction side 38. The cavity 14, as shown in FIG. 2, may be positioned in inner aspects of the airfoil 24 for directing one or more gases, which may include air received from a compressor (not shown), through the airfoil 24 to reduce the temperature of the airfoil 24. The cavity 14 may be arranged in various configurations and is not limited to a particular flow path.

Figure 3:
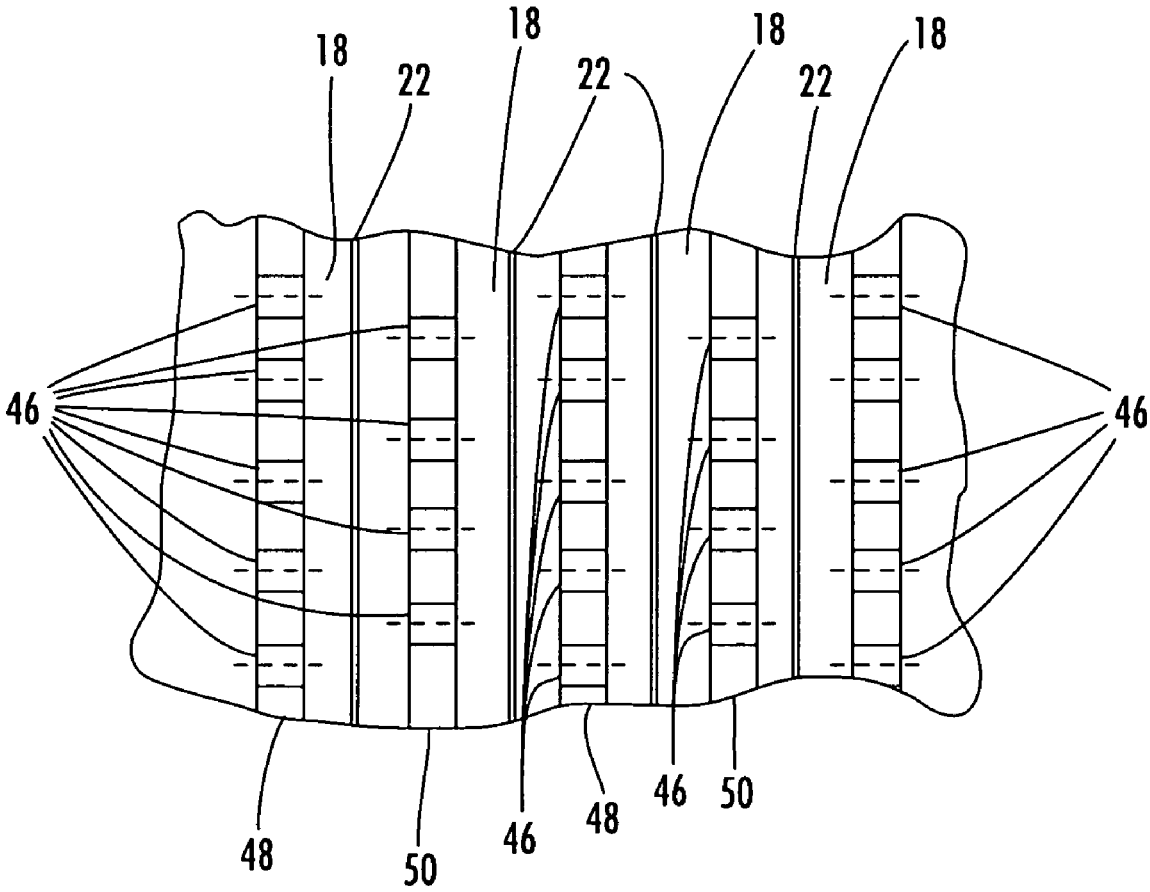
FIG. 3 is a detailed cross-sectional view of a portion of the vortex cooling chambers shown in FIG. 2 along line 3-3.
Figure 4:
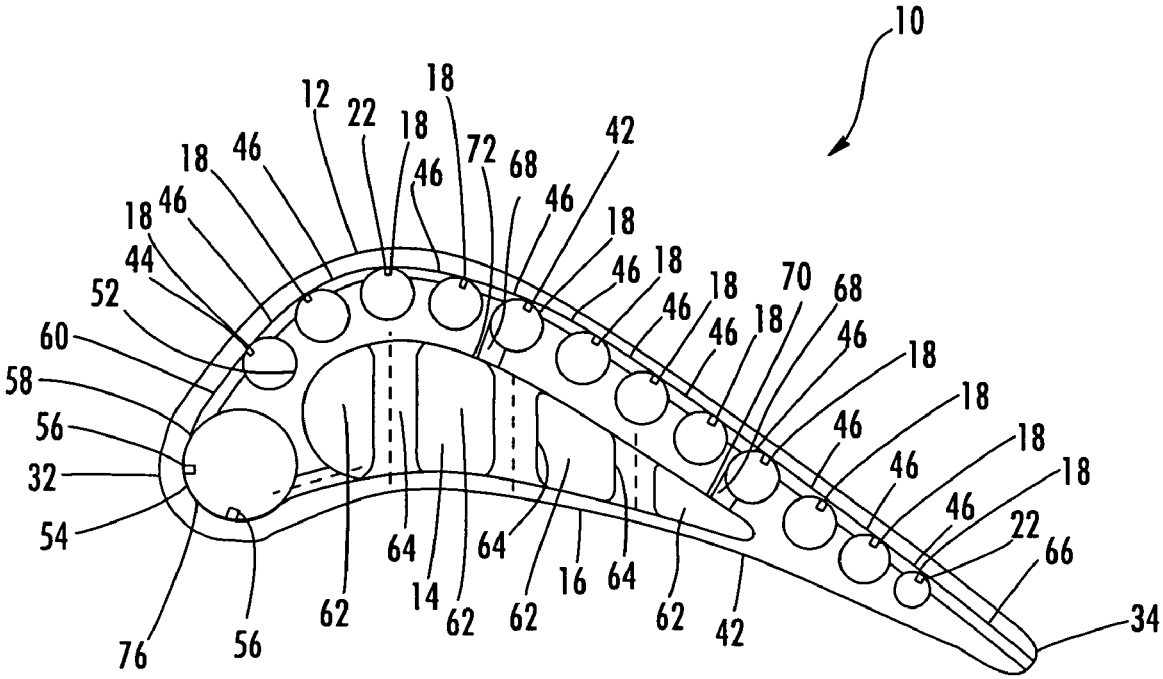
FIG. 4 is a cross-sectional view of an alternative configuration of a cooling system in the turbine airfoil shown in FIG. 1 taken along line 4-4.

The cooling system 10, as shown in FIGS. 2-4, may include one or more vortex cooling chambers 18 positioned in the outer wall 16 of the generally elongated, hollow airfoil. In one embodiment, as shown in FIG. 2, the outer wall 16 proximate to the suction side 38 may have a thickness that is greater than a thickness of the pressure side 36. In other embodiments, the relative thicknesses may be different. The vortex cooling chambers 18 may extend in a generally spanwise direction from the root 26 to the tip section 30, or at any length therebetween. In one embodiment, the vortex cooling chambers 18 may have generally cylindrical cross-sections. In other embodiments, the vortex cooling chambers 18 may have alternative configurations. The vortex cooling chambers 18 may be aligned, as shown in FIG. 2. In one embodiment, the cooling system 10 may be formed from twelve vortex cooling chambers 18. However, in other embodiments, the number of vortex cooling chambers 18 may number more or less than twelve. A first vortex cooling chambers 44 may be positioned in close proximity to the leading edge 32 of the airfoil 24. The remaining vortex cooling chambers 18 may be positioned in the outer wall 16 on the suction side 38 proximate to an outer surface 42 of the outer wall 16 and extend to the trailing edge 34 of the airfoil 24.

The vortex cooling chambers 18 may be in fluid communication with each other through one or more vortex cooling chamber bleed slots 46. The vortex cooling chambers 18 may meter the flow of cooling fluids into the vortex cooling chambers 18. In one embodiment, as shown in FIG. 3, each vortex cooling chamber 18 may be fed with cooling fluids through a plurality of vortex cooling chamber bleed slots 46. The vortex cooling chamber bleed slots 46 may provide near wall cooling to the outer wall 16. The vortex cooling chamber bleed slots 46 may be evenly spaced or have another configuration. The vortex cooling chamber bleed slots 46 in a first row 48 may be offset in a generally spanwise direction from vortex cooling chamber bleed slots 46 in a second row 50. This pattern may be repeated throughout the vortex cooling chambers 18. The vortex cooling chamber bleed slots 46 may also be positioned such that the vortex cooling chamber bleed slots 46 intersect with a vortex cooling chamber 18 tangentially with the vortex cooling chamber 18 proximate to the outer surface 42 of the generally elongated, hollow airfoil 24. In this position, cooling fluids entering the vortex cooling chambers 18 flow around an inner surface 52 of the vortex cooling chambers 18 and form vortices within the vortex cooling chambers 18. The vortex cooling chamber bleed slots 46 may be positioned proximate to the outer surface 42 of the suction side 38 outer wall 16.

The vortex cooling chambers 18 may include one or more trip strips 22 for increasing the cooling capacity of the system 10. In at least one embodiment, the trip strips 22 may extend generally spanwise and be positioned on an inner surface 52 of the vortex cooling chambers 18 proximate to an outer surface 42 of the suction side 38 of the generally elongated, hollow airfoil 24. The trip strips 22 may extend for the entire length of the vortex cooling chambers 18 or only a portion of the vortex cooling chambers 18.

The turbine airfoil cooling system 10 may also include one or more leading edge cooling channels 54 positioned proximate to the leading edge 32. The leading edge cooling channel 54 may extend from proximate the root 26 to the tip section 30, or have a shorter length. The leading edge cooling channel 54 may include a plurality of trip strips 56 on the inner surface 58. The trip strips 56 may extend generally spanwise within the leading edge cooling channel 54. The leading edge cooling channel 54 may include one or more rows of trip strips 56. The leading edge cooling channel 54 may be in fluid communication with the vortex cooling chamber 44 through one or more leading edge bleed slots 60. The leading edge bleed slots 60 may intersect with the vortex cooling chamber 44 generally tangential to a surface of the vortex cooling chamber 44 closest to the outer surface 42 of the outer wall 16.

The turbine airfoil cooling system may include one or more trailing edge bleed slots 66. The trailing edge bleed slots 66 may be in fluid communication with one or more vortex cooling chambers 18. The trailing edge bleed slots 66 enable cooling fluids to be exhausted from the vortex cooling chambers 18 through the trailing edge 34.

The internal cavity 14 of the airfoil 12 may be formed from one or more central cooling fluid chambers 62. The central cooling fluid chamber 62 may have any appropriate configuration. The central cooling fluid chamber 62 may function as a pressure side 36 cooling chamber. The central cooling fluid chamber 62 may extend from the root 26 to the tip section 30, or have a shorter length. In at least one embodiment, as shown in FIG. 2, the central cooling fluid chamber 62 may include one or more pin fins 64 extending generally from the outer wall 16 on the pressure side 36 toward the outer wall 16 on the suction side 38. The pin fins 64 may have generally cylindrical cross-sections or other appropriate shaped cross-sections. The central cooling fluid chamber 62 may be in fluid communication with the leading edge cooling channel 54 through one of more central cooling fluid chamber bleed slots 74. The central cooling fluid chamber bleed slots 74 may intersect the leading edge cooling channel 62 such that the central cooling fluid chamber bleed slots 74 are generally tangential with an inner surface 76 of the central cooling fluid chamber bleed slots 74 to create vortices within the leading edge cooling channel 62. The central cooling fluid chamber bleed slots 74 may be positioned proximate to the pressure side 36 in an another appropriate configuration. In at least one embodiment, the ratio of bleed slot width of the central cooling fluid chamber bleed slot 74 to a diameter of a cross-section of the leading edge cooling channel 54 may be greater than about 10 and less than about 20 to generate a high internal heat transfer coefficient for vortex cooling.

In an alternative embodiment, as shown in FIG. 4, the turbine airfoil cooling system 10 may also include one or more re-supply holes 68 that places one or more vortex cooling chambers 18 in direct fluid communication with the central cooling fluid chamber 62. The re-supply holes 68 may be placed in any appropriate position as determined by local heat loads. In one embodiment, the re-supply holes 68 may be positioned downstream of a vortex cooling chamber row 44 that is adjacent to the leading edge cooling chamber 54 and at least one second re-supply hole 70 positioned downstream of the first re-supply hole 72. The size and configuration of the re-supply holes 68 may be based upon heat loads, pressure ranges, and other criteria. A larger or smaller number of re-supply holes 68 may be used in other embodiments.

During use, cooling fluids may flow into the central cooling fluid chamber 62 and past the pin fins 64. The cooling fluids may increase in temperature as the cooling fluids flow through the internal aspects of the turbine airfoil 12. The cooling fluids may then pass through the central cooling fluid chamber bleed slots 74 and into the leading edge cooling channel 54. The central cooling fluid chamber bleed slots 74 may create vortices of cooling fluids entering the leading edge cooling channel 54. The trip strips 56 may also increase the turbulence in the leading edge cooling channel 54. The cooling fluids then flow through the leading edge bleed slots 60 and into the vortex cooling chamber 44. As previously discussed, the configuration of the intersection between the leading edge bleed slots 60 and the vortex cooling chamber 44 creates vortices in the vortex cooling chamber 44. The vortex cooling chambers 44 generate high spanwise average internal heat transfer coefficient for airfoil cooling purposes. The vortex cooling chambers 44 also provide uniform cooling for the suction side 38 near wall 16 as a result of the cooling fluids transferring heat from the outer wall 16 to the inner surface of the outer wall 16. In addition, the trip strips 22 increase the turbulence in the vortex cooling chamber 44. The cooling fluids flow through the other vortex cooling chambers 18 and increase in temperature. The cooling fluids may then be discharged from the turbine airfoil cooling system 10 through the trailing edge bleed slots 66.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

an outer wail forming the generally elongated airfoil, wherein a portion of the outer wall proximate to a suction side of the generally elongated airfoil includes a plurality of vortex cooling chambers extending in a generally spanwise direction;

wherein at least one row of the vortex cooling chambers is positioned in close proximity to the leading edge of the generally elongated, hollow airfoil;

at least one vortex cooling chamber bleed slot positioned between each row of vortex cooling chambers and in communication with the adjacent vortex cooling chambers;

at least one trailing edge bleed slot extending from one of the vortex cooling chambers through the trailing edge for exhausting cooling fluids from the generally elongated airfoil;

wherein the vortex cooling chambers, the at least one vortex cooling chamber bleed slot, and the at least one trailing edge bleed slot form a continuous cooling circuit in the outer wall of the generally elongated, hollow airfoil from close proximity of the leading edge, along the suction side and through the trailing edge; and a leading edge cooling channel positioned proximate to the leading edge and extending generally spanwise and at least one leading edge bleed slot positioned in the outer wall and extending between the leading edge cooling channel and at least one of the plurality of vortex cooling chambers.

2. The turbine airfoil of claim 1, wherein the at least one vortex cooling chamber bleed slot comprises a plurality of bleed slots extending generally spanwise in the outer wall.

3. The turbine airfoil of claim 2, wherein the plurality of bleed slots form a first row of vortex cooling chamber bleed slots that are offset in a spanwise direction from a second row of vortex cooling chamber bleed slots positioned adjacent to the first row.

4. The turbine airfoil of claim 3, wherein a pattern formed from the first and second offset rows of vortex cooling chamber bleed slots is repeated throughout the rows of vortex cooling chambers and rows of vortex cooling chamber bleed slots.

5. The turbine airfoil of claim 1, wherein the at least one vortex cooling chamber bleed slot positioned between each row of vortex cooling chambers and in communication with the adjacent vortex cooling chambers extends into contact with each vortex cooling chamber along a line generally tangential to an inner surface of the vortex cooling chamber proximate to an outer surface of the suction side of the airfoil.

6. The turbine airfoil of claim 1, wherein the at least one cavity in the elongated, hollow airfoil comprises at least one central cooling fluid chamber.

7. The turbine airfoil of claim 6, wherein the central cooling fluid chamber is in fluid communication with the leading edge cooling channel through at least one central cooling fluid chamber bleed slot.

8. The turbine airfoil of claim 7, wherein the at least one central cooling fluid chamber bleed slot is positioned proximate to a pressure side of the generally elongated, hollow airfoil.

9. The turbine airfoil of claim 6, further comprising a plurality of pin fins positioned within the central cooling fluid chamber extending generally from an outer wall on a pressure side toward the suction side.

10. The turbine airfoil of claim 1, further comprising a plurality of trip strips positioned in the at least one leading edge cooling channel.

11. The turbine airfoil of claim 1, wherein at least a portion of the plurality of vortex cooling chambers include trip strips.

12. The turbine airfoil of claim 11, wherein the plurality of vortex cooling chambers include trip strips extending generally spanwise and positioned on an inner surface of the vortex cooling chambers proximate to an outer surface of the suction side of the generally elongated, hollow airfoil.

13. The turbine airfoil of claim 1, further comprising at least one re-supply hole in the outer wall placing at least one of the plurality of vortex cooling chambers in communication with a central cooling fluid chamber.

14. The turbine airfoil of claim 13, wherein the at least one re-supply hole comprises at least one first re-supply hole positioned downstream of a vortex cooling chamber that is adjacent to the leading edge cooling channel and at least one second re-supply hole positioned downstream of the first re-supply hole.

15. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

an outer wall forming the generally elongated airfoil, wherein a portion of the outer wall proximate to a suction side of the generally elongated airfoil includes a plurality of vortex cooling chambers extending in a generally spanwise direction;

wherein the at least one cavity in the elongated, hollow airfoil comprises at least one central cooling fluid chamber;

a leading edge cooling channel positioned proximate to the leading edge and extending generally spanwise;

at least one leading edge bleed slot positioned in the outer wall and extending between the leading edge cooling channel and at least one of the plurality of vortex cooling chambers;

at least one vortex cooling chamber bleed slot positioned between each row of vortex cooling chambers and in communication with the adjacent vortex cooling chambers;

at least one trailing edge bleed slot extending from one of the vortex cooling chambers through the trailing edge for exhausting cooling fluids from the generally elongated airfoil; and at least one re-supply hole in the outer wall placing at least one of the plurality of vortex cooling chambers in communication with a central cooling fluid chamber.

16. The turbine airfoil of claim 15, wherein the at least one vortex cooling chamber bleed slot comprises a plurality of bleed slots positioned in rows extending generally spanwise in the outer wall that repeat a pattern in which a first row of vortex cooling chamber bleed slots are offset in a spanwise direction from a second row of vortex cooling chamber bleed slots positioned adjacent to the first row.

17. The turbine airfoil of claim 16, wherein the at least one vortex cooling chamber bleed slot positioned between each row of vortex cooling chambers and in communication with the adjacent vortex cooling chambers extends into contact with the each vortex cooling chamber along a line generally tangential to an inner surface of the vortex cooling chamber proximate to an outer surface of the suction side.

18. The turbine airfoil of claim 15, wherein the central cooling fluid chamber is in fluid communication with the leading edge cooling channel through at least one central cooling fluid chamber bleed slot positioned proximate to a pressure side of the generally, elongated, hollow airfoil and further comprises a plurality of pin fins extending generally from an outer wall on a pressure side of the airfoil toward the suction side in the central cooling fluid chamber.

19. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

an outer wall forming the generally elongated airfoil, wherein a portion of the outer wall proximate to a suction side of the generally elongated airfoil includes a plurality of vortex cooling chambers extending in a generally spanwise direction;

wherein at least one row of the vortex cooling chambers is positioned in close proximity to the leading edge of the generally elongated, hollow airfoil;

at least one vortex cooling chamber bleed slot positioned between each row of vortex cooling chambers and in communication with the adjacent vortex cooling chambers; and at least one trailing edge bleed slot extending from one of the vortex cooling chambers through the trailing edge for exhausting cooling fluids from the generally elongated airfoil;

wherein the vortex cooling chambers, the at least one vortex cooling chamber bleed slot, and the at least one trailing edge bleed slot form a continuous cooling circuit in the outer wall of the generally elongated, hollow airfoil from close proximity of the leading edge, along the suction side and through the trailing edge; and at least one re-supply hole in the outer wall placing at least one of the plurality of vortex cooling chambers in communication with a central cooling fluid chamber.

20. The turbine airfoil of claim 19, wherein the at least one re-supply hole comprises at least one first re-supply hole positioned downstream of a vortex cooling chamber that is adjacent to the leading edge cooling channel and at least one second re-supply hole positioned downstream of the first re-supply hole.

* * * * *